US005947473A

United States Patent [19]

Spitzer

[11] Patent Number: 5,947,473

[45] Date of Patent: Sep. 7, 1999

[54] TOY SLIDE PUZZLE

[76] Inventor: Lynn Spitzer, 20 S. Letitia St., Suite C, Philadelphia, Pa. 19106

[21] Appl. No.: 08/815,276

[22] Filed: Mar. 10, 1997

Related U.S. Application Data

[63] Continuation of application No. 08/528,297, Sep. 14, 1995, abandoned.

[51] Int. Cl.[6] ..... A63F 9/08

[52] U.S. Cl. ..... 273/153 S

[58] Field of Search ..... 273/153 R, 153 S, 273/155

[56] References Cited

U.S. PATENT DOCUMENTS

| | | | |
|---|---|---|---|
| 636,109 | 10/1899 | Bowers | 273/155 |
| 2,948,535 | 8/1960 | Ellman | 273/153 S |
| 3,946,514 | 3/1976 | Joslyn | 273/153 S |
| 4,415,158 | 11/1983 | Engel | 273/153 S |
| 4,509,756 | 4/1985 | Moscovich | 273/153 S |
| 4,793,615 | 12/1988 | Martin | 273/153 S |

*Primary Examiner*—Steven Wong
*Attorney, Agent, or Firm*—Grimes & Battersby

[57] ABSTRACT

A puzzle is provided comprising a base portion with an upper and a lower surface. A pictorial representation is provided on the upper surface of the base portion. Portions are removed from the pictorial representation at predetermined positions to create a plurality of blank portions. A track is provided through the upper surface interconnecting these blank portions. A plurality of manipulative elements are further provided which are fixedly secured within the track. Each of the manipulative elements have an upper face surface which includes an illustration corresponding to those removed portions of the pictorial representation. A successful solution to the puzzle is achieved by: (1) maneuvering the manipulative elements about the track such that each of the manipulative elements are positioned with their upper face surfaces positioned over one of the blank portions with their illustrations corresponding to the removed portion of the pictorial representations; and (2) rotating each of the manipulative elements to align the illustration on its upper surface with the portion of said pictorial representation surrounding the blank portion.

5 Claims, 6 Drawing Sheets

TOY SLIDE PUZZLE

RELATED APPLICATIONS

This is a continuation application of U.S. patent application Ser. No. 08/528,297 filed on Sep. 14, 1995 now abandoned in the name of Lynn Spitzer for Toy Slide Puzzle.

FIELD OF THE INVENTION

The present invention relates generally to a toy slide puzzle and, more particularly, to such a slide puzzle that permits the user to maneuver and position a plurality of manipulative, rotatable puzzle elements within and along pre-defined channels provided on a base portion to achieve a puzzle solution by completing a pictorial representation contained on the face of the base portion of said puzzle. The manipulative elements are adapted to travel both linearly along the pre-defined channels and rotationally within such channels to achieve the puzzle solution.

By providing the manipulative elements within and along the pre-defined channels, the puzzle of the present invention effectively eliminates the problem inherent in many puzzles—losing or misplacing the puzzle elements. Furthermore, the present invention prevents younger children from swallowing small puzzle elements. It further presents to such children the task of solving a puzzle that requires a different type of strategy and hand movement than those currently available. The present invention may be made more complicated for adults by designing the puzzle so that puzzle elements may have to be moved in a particular order to place a given piece in its correct position in the puzzle.

DESCRIPTION OF THE PRIOR ART

The prior art fails to specifically address either the problem or the solution arrived upon by applicant. Puzzles in which the user is required to assemble portions or components to form a pictorial representation have been known since the 19th Century. For example, U.S. Pat. No. 408,148 which issued to G. E. Throop on Jul. 30, 1889 for a Toy. Rotatable puzzles, in which a plurality of rotatable discs are provided on a base which must be rotated in order to display the pictorial representation have also been known since the past century. See, for example, U.S. Pat. No. 636,109 which issued to H. A. Bowers on Oct. 31, 1899 for a Puzzle. A similar puzzle had been marketed by Pentangle in the early 1980's under the mark Rotoscope. See, also, U.S. Pat. No. 4,550,040 which issued to D. Fisher on Oct. 29, 1985 for Movable Mosaics; U.S. Pat. No. 4,580,783 which issued to H. Cohan on Apr. 8, 1986 for Puzzle Comprising Overlapping Circles with Interchangeable Components; U.S. Pat. No. 4,735,417 which issued to M. J. Gould on Apr. 5, 1988 for Puzzle; U.S. Pat. No. 4,978,126 which issued to L. Morosow et al. on Dec. 18, 1990 for Rotating Amusement Device; and U.S. Pat. No. 5,135,225 which issued to E. Pszotka et al. on Aug. 4, 1992 for Overlapping Rotatable Disc Type Puzzle.

Slide puzzles in which puzzle components are slide along certain tracks have similarly been known for many years. See, for example, U.S. Pat. No. 4,333,652 which issued to R. E. Clancy on Jun. 8, 1982 for a Two-Sided Puzzle. U.S. Pat. No. 4,509,756 which issued to I. Moscovich on Apr. 9, 1985 for Puzzle with Elements Transferable Between Closed-Loop Paths illustrates form of such puzzle in which a plurality of manipulative elements are movable within the holder along a plurality of closed-loop paths.

As will be appreciated, none of these prior patents even address the problem faced by applicant let alone offer the solution proposed herein.

SUMMARY OF THE INVENTION

Against the foregoing background, it is a primary object of the present invention to provide a slide puzzle which includes a base portion having a plurality of slide tracks along which a plurality of manipulative elements are adapted to be moved to achieve a particular puzzle solution.

It is another object of the present invention to provide such a slide puzzle in which the manipulative elements are rotatable within the slide tracks and may be individually rotated in order to achieve the particular puzzle solution.

It is still another object of the present invention to provide such a slide puzzle in which the manipulative elements are secured within the slide tracks to prevent them from being lost or misplaced.

It is yet another object of the present invention to provide such a slide puzzle that prevents small children from swallowing the manipulative elements.

It is another object of the present invention to provide such a slide puzzle that is easy and practical to play with during car, train and plane trips.

It is still yet another object of the present invention to provide such a slide puzzle that requires a different strategy and hand movement to achieve the puzzle solution.

To the accomplishments of the foregoing objects and advantages, the present invention, in brief summary, comprises a puzzle having a base portion with an upper and a lower surface. A pictorial representation is provided on the upper surface of the base portion. Portions are removed from the pictorial representation at predetermined positions to create a plurality of blank portions. A track is provided through the upper surface interconnecting these blank portions. A plurality of manipulative elements are further provided which are fixedly secured within the track. Each of the manipulative elements have an upper face surface which includes an illustration corresponding to those removed portions of the pictorial representation. A successful solution to the puzzle is achieved by: (1) maneuvering the manipulative elements about the track such that each of the manipulative elements are positioned with their upper face surfaces positioned over one of the blank portions with their illustrations corresponding to the removed portion of the pictorial representations; and (2) rotating each of the manipulative elements to align the illustration on its upper surface with the portion of said pictorial representation surrounding the blank portion.

BRIEF DESCRIPTION OF THE DRAWINGS

The foregoing and still other objects and advantages of the present invention will be more apparent from the detailed explanation of the preferred embodiments of the invention in connection with the accompanying drawings, wherein.

DESCRIPTION OF THE PREFERRED EMBODIMENTS

Figure 1:
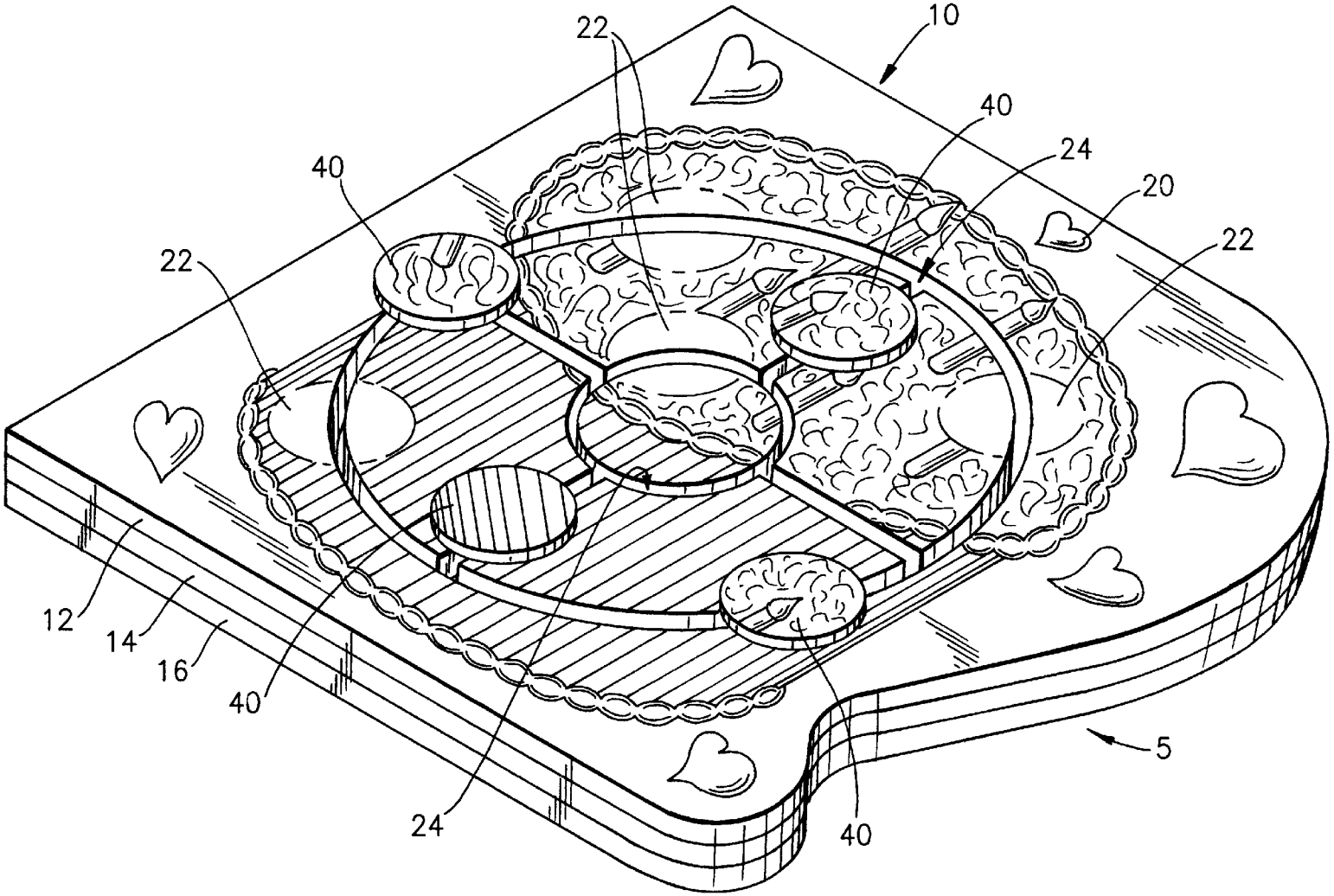
FIG. 1 is a front perspective view of the slide puzzle of the present invention.
Figure 2:
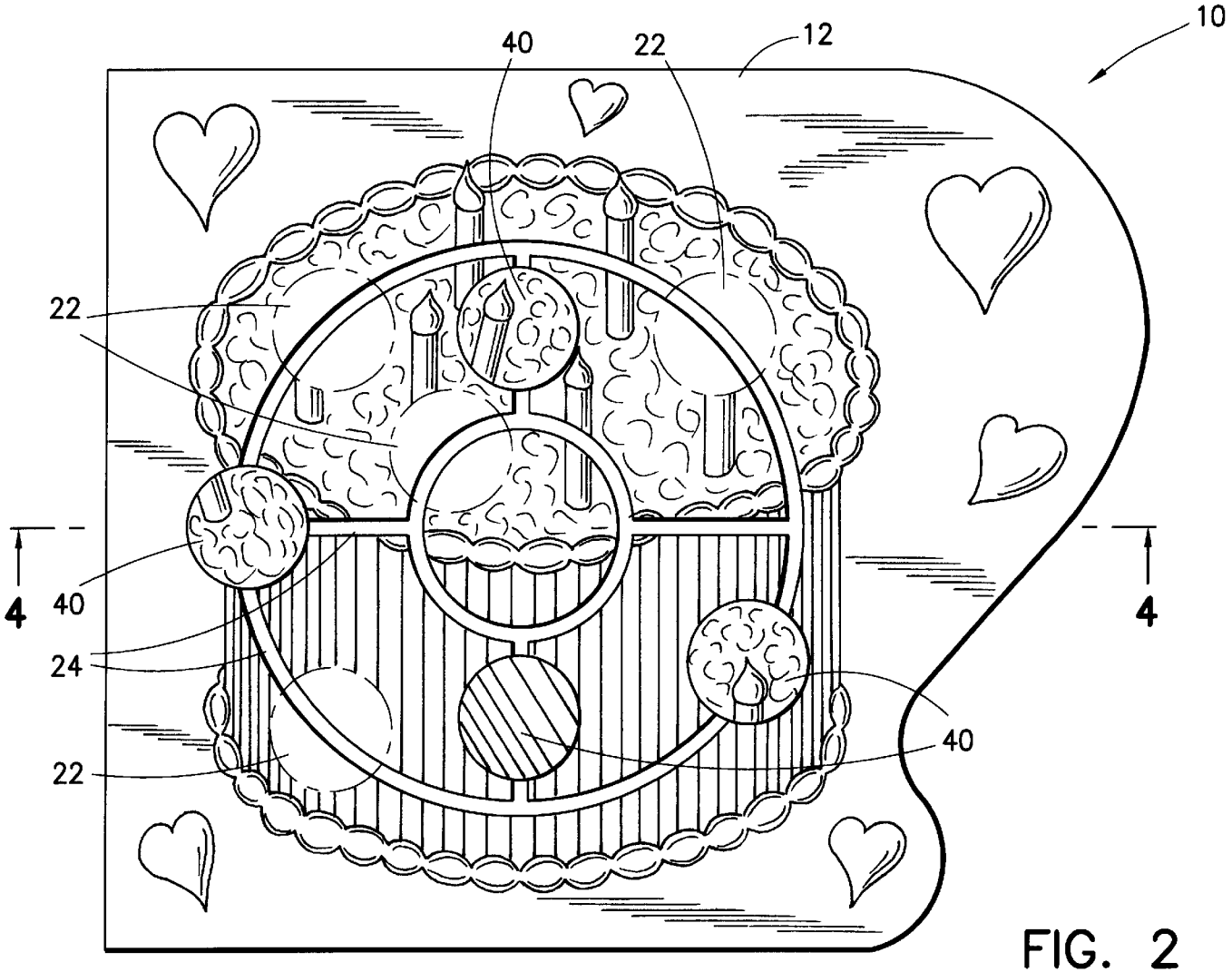
FIG. 2 is a top plan view of the slide puzzle of FIG. 1.
Figure 3C:
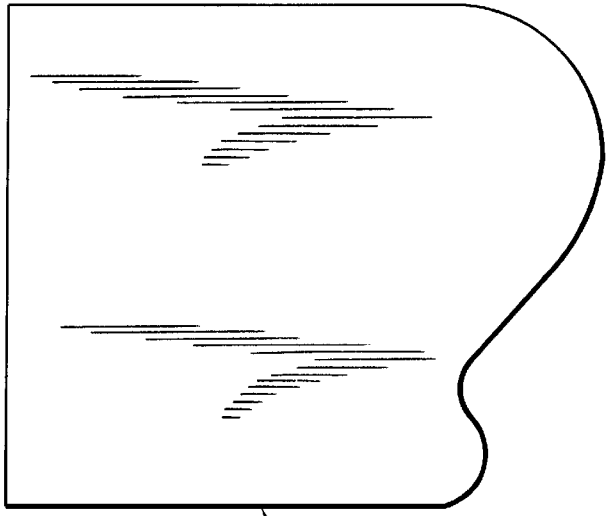
FIG. 3C is a top plan view of the lower level of the base portion of the slide puzzle of FIG. 1.
Figure 3B:
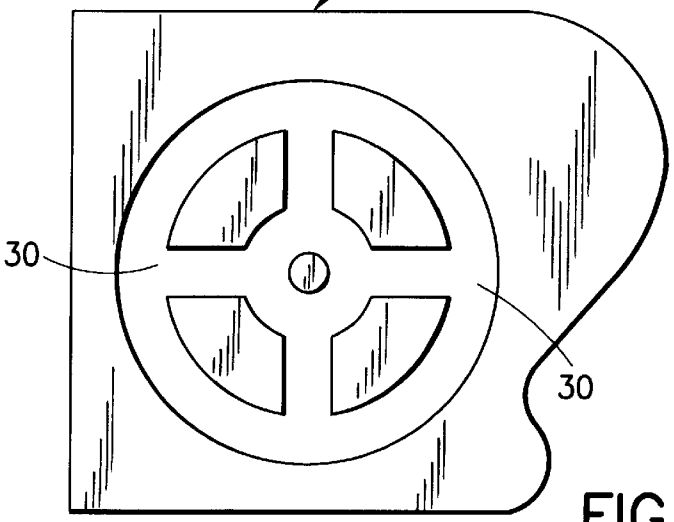
FIG. 3B is a top plan view of the intermediate layer of the base portion of the slide puzzle of FIG. 1.
Figure 3A:
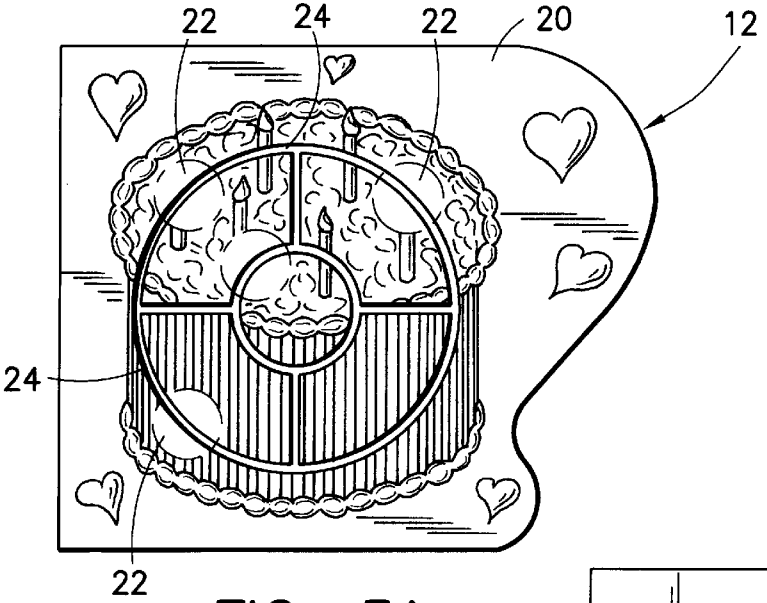
FIG. 3A is a top plan view of the upper pictorial layer of base portion of the slide puzzle of FIG. 1.

Referring to the drawings and, in particular, to FIGS. 1–3 thereof, the new slide puzzle of the present invention referred to generally by reference numeral 5 comprises a base portion referred to generally by reference numeral 10. Base portion 10 includes a top face layer 12, an intermediate layer 14 and a lower base layer 16, each of substantially the same shape and configuration. The base layer 16 is a solid, planar backing layer providing support for the slide puzzle 5 and may, if desired, be formed integrally with the intermediate layer 14 (not shown). The size and shape of the base portion 10 may vary from puzzle to puzzle. The layers 12–16 are preferably formed from a cardboard type material although they may be formed of virtually any suitable material including, for example, wood or a thermoplastic material.

In alternate embodiments (not pictured) of the present invention, the base portion 10 may be manufactured out of different layers or different materials. The base layer 16 and intermediate layer 14 may be vacuum formed together from one thin plastic sheet and a backer board or stabilizing layer adhered to the bottom to cover the plastic and add strength. Alternatively, the base layer 16 and intermediate layer 14 may be formed by routing a single piece of material. Injection molding may also be used to create a single piece that performs the same functions as the base layer 16 and intermediate layer 14 described above. The shape and dimensions of the slide puzzle 5 may also be increased or decreased depending upon its application.

A pictorial representation 20 for the particular slide puzzle is provided on the face layer 12 of the base portion 10. It will, of course, be appreciated that the pictorial representations 20 provided on the face layer 12 of the slide puzzle 5 of the present invention will vary from puzzle to puzzle. A plurality of blank portions 22 are provided at predetermined positions about the pictorial representation 20.

The face layer 12 of the base portion 10 further includes a it pattern of interconnecting tracks 24 which constitute cut-outs through the face layer 12. Interconnecting tracks 24 intersect the blank portions 22 of the pictorial representation 20 on the face layer. The pattern for the interconnecting tracks 24 is pre-defined although it may be symmetrical or asymmetrical.

Figure 4:
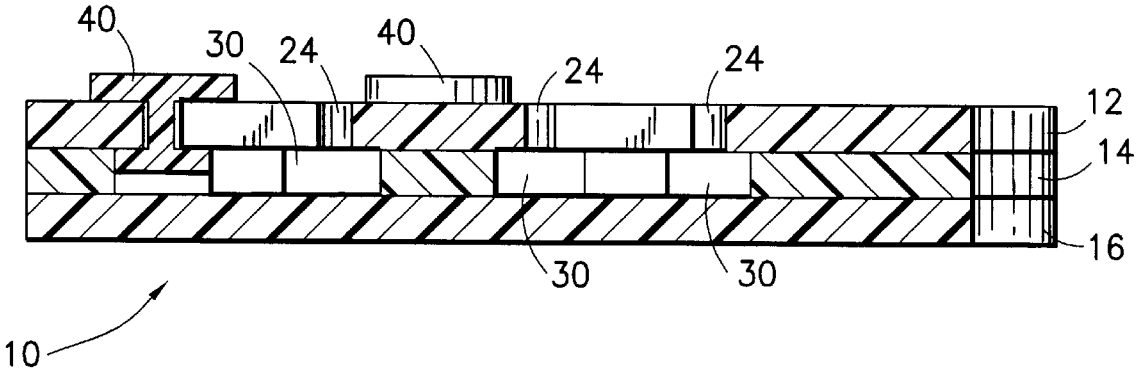
FIG. 4 is a cross-sectional side view of the base portion of the slide puzzle of FIG. 1 taken along line 4—4 of FIG. 2.
Figure 5A:
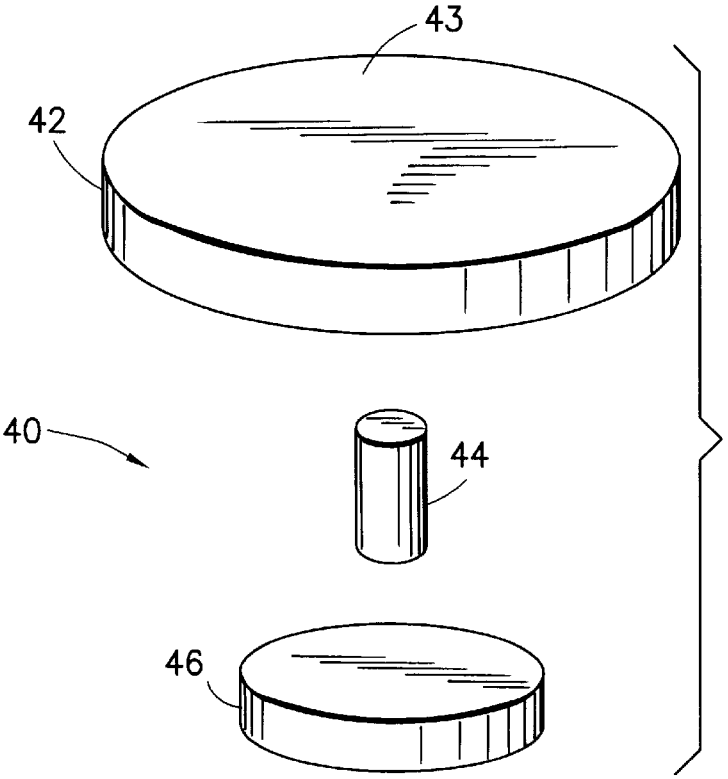

Channels 30 are provided on the surface of the intermediate layer 14 and are positioned complimentary to the tracks 24 on and through the face layer 12. As shown in FIG. 4, the width of the channels 30 is substantially greater than the width of the tracks 24 on the face layer 12.

Figure 5:
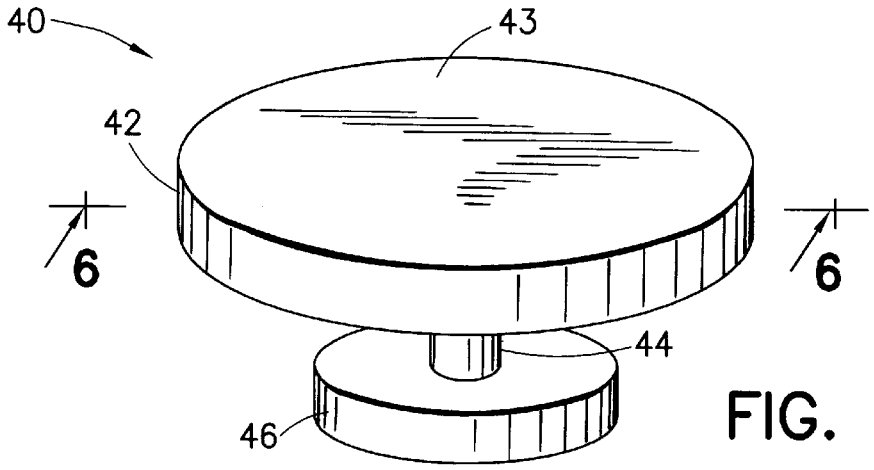
FIG. 5 is a perspective view of one of the manipulatable puzzle elements used in conjunction with the slide puzzle of FIG. 1.
Figure 6:
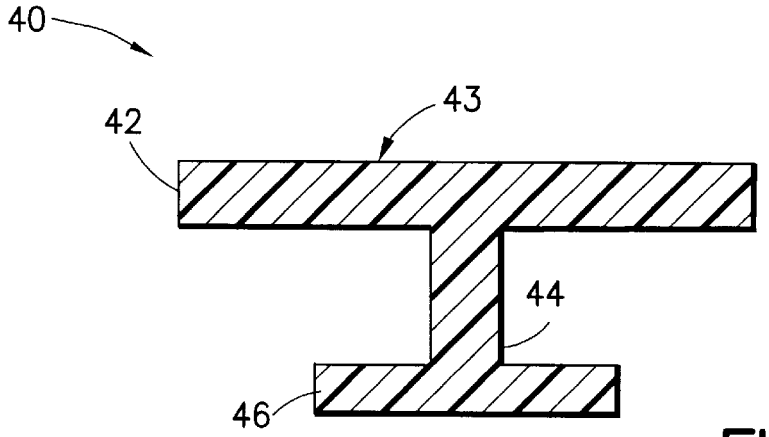
FIG. 6 is a cross-sectional side view of the manipulative puzzle element of FIG. 5 taken along line 6—6 of FIG. 5.
Figure 7:
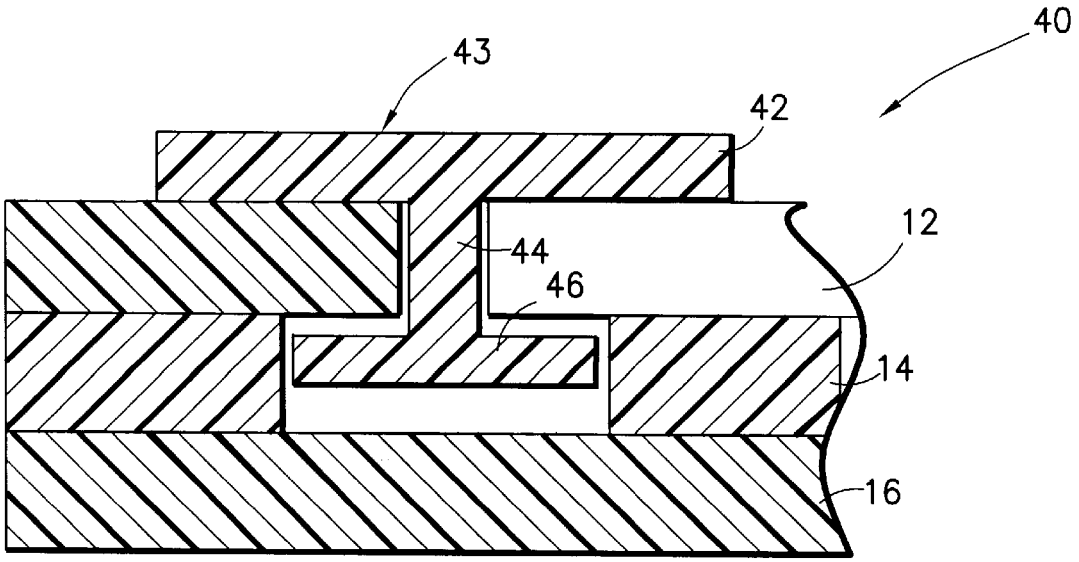
FIG. 7 is a cross-sectional view of the slide puzzle of FIG. 1 illustrating the manner in which the manipulative puzzle element is positioned within the slide tracks of the base portion.

The slide puzzle 5 further includes a plurality of manipulative elements 40 which are shown in greater detail in FIGS. 5–6. The interrelationship between the manipulative elements 40 and the base portion 10 is shown in greater detail in FIG. 7.

Manipulative elements 40 each include an upper segment 42 having an upper face surface 43, a neck segment 44 and a lower base segment 46. The upper segments 42 are preferably round and are of a width and dimension to substantially conform to the blank portions 22 contained in the pictorial representation 20 on the face layer 12 of the base portion 10.

Similarly, the width of the neck segment 44 of the manipulative element 40 is adapted to conform to the width of the tracks 24 in the face layer 12 of the base portion 10 and the width of the base segment 46 is greater than the width of the neck segment 44 yet less than the width of the channel 30 provided in the intermediate layer 14 of the base portion. In such a manner, the manipulative elements 40 are adapted to be moved around the tracks 24 contained on the face layer 12 yet be retained within the channel 30 provided in the intermediate layer 14 to avoid removal of the manipulative elements from the puzzle and possible loss. Similarly, each of the manipulative elements 40 may be rotated relative to the track 24.

The portions of the pictorial representation 20 of the face layer 12 that are removed to create the blank portions 22 are printed on the face surfaces 43 of the upper segments 42 of the manipulative elements 40. There are thus a like number of manipulative elements 40 to blank portions 22.

A successful solution to the slide puzzle of the present invention is achieved by maneuvering all of the manipulative elements 40 around the tracks 24 so that the face surfaces 43 of the manipulative elements 40 conform to the blank portions 22. This is, of course, achieved, by not only positioning each manipulative element 40 over the appropriate blank portion 22 but, in addition, rotating such manipulative elements 40 in an appropriate manner to align the artwork on the face surface 43 of the manipulative element 40 to the artwork on the face layer 12 surrounding the blank portion 22. This two step process is required in order to achieve a successful solution to the puzzle.

Figure 8:
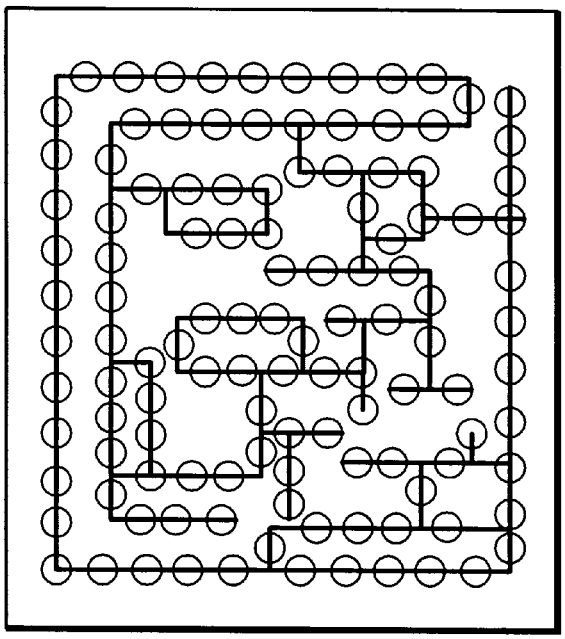
FIG. 8 is a top plan view of the base portion of an alternative embodiment of the slide puzzle of the present invention.
Figure 9:
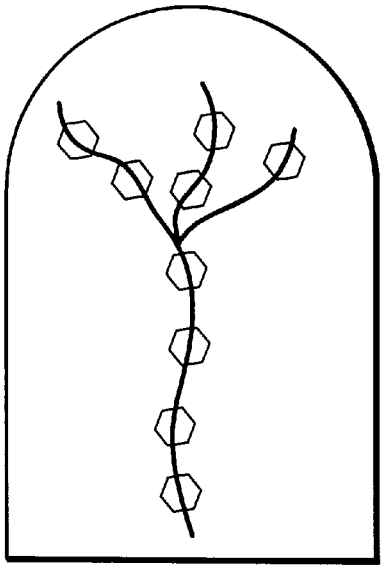
FIG. 9 is a top plan view of the base portion of another alternative embodiment of the slide puzzle of the present invention.
Figure 10:
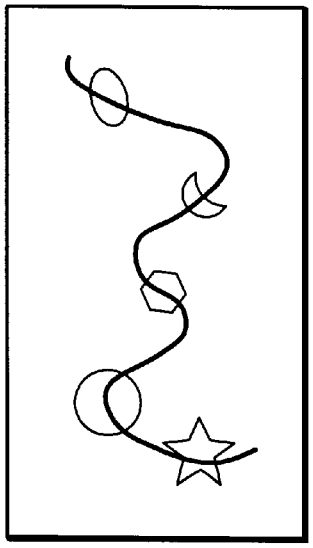
FIG. 10 is a top plan view of the base portion of yet another alternative embodiment of the slide puzzle of the present invention.

FIGS. 8–10 illustrate alternative designs and configurations of the puzzle of the present invention that can be employed. For example, the slide puzzle 105 of FIG. 8 takes the form of a maze; the slide puzzle 205 of FIG. 9 takes the form of a tree; and the slide puzzle of FIG. 10 takes the form of an interconnected arrangement of shapes.

In another alternative embodiment (not pictured) the tracks 24 could run entirely through base portion 10 and the manipulative elements 40 could consist of two upper face surfaces 43 separated by a neck segment 44 which fits through the track 24. The base portion 10 and manipulative elements 40 could then be imprinted with images on both sides, essentially creating two puzzles—one on each side of the base portion 10.

It will be appreciated that other forms and configurations for the slide puzzle of the present invention is possible. The number of manipulative elements 40 can be increased or decreased depending upon the difficulty of the puzzle. Additionally, the size and shapes of the manipulative elements 40 can also be changed to accommodate young children or adults, provided the to pieces are still capable of linear and rotational motion and are still constrained within the base portion 10 of the puzzle. Furthermore, the complexity of the puzzle 5, the number of tracks 24 and blank portions 22 can be altered to make the puzzle easy for young children and more difficult for adults. The patterns of the tracks 24 can also be altered to make it more difficult to move a given piece to its correct position without affecting other pieces already in their correct position.

The manipulative elements 40 can also be three-dimensional to enhance the design and allow younger children to grasp them more easily. Also, the base portion 10 could take the form of a sphare and the manipulative elements 40 could be shapted to conform to the shape of the sphere. Additionally, the base portion 10 could display the entire picture without missing portions. Furthermore, the blank portions 22 of the pictorial representation 20 may be recessed into the base portion 10 so as to accomodate the top section 42 of the manipulative elements 40.

Having thus described the invention with particular reference to the preferred forms thereof, it will be obvious that various changes and modifications can be made therein without departing from the spirit and scope of the present invention as defined by the appended claims.

Wherefore, I claim:

1. A puzzle comprising:

a base comprising a top layer, an intermediate layer and a lower layer, said base having at least one pictorial representation provided on a surface thereof, said pictorial representation having sections removed therefrom to provide a plurality of blank sections at predetermined positions about said pictorial representation;

a track network provided within said base which interconnects said plurality of blank sections, said track network including an upper section provided in said top layer and a lower section provided in said intermediate layer, wherein the width of said lower section is greater than the width of said upper section;

a plurality of independently rotatable, manipulative elements adapted to be moved curvilinearly about said track network from blank section to blank section without the necessity to remove said manipulative elements from said track network and, upon positioning of said elements within their appropriate blank section, further adapted to be rotated at said blank section relative to said pictorial representation to achieve a solution for said puzzle, wherein each of said elements include:

a face portion of a size and shape that substantially conforms to said blank sections in said base, said face portion including on an outer surface thereof a portion of said pictorial representation removed therefrom;

a neck portion which extends through said upper section of said track network and permits travel of said manipulative element about said track network from said blank section to said blank section; and a base portion adapted to retain said element within said track network while permitting said element to travel about said track network while further permitting said element to rotate relative to said base, wherein the width of said base portion is greater than the width of said upper section, thereby retaining said element within said track network.

2. The puzzle of claim 1, wherein said pictorial representation is provided on a surface of said top layer and wherein a second pictorial representation is provided on a surface of said lower layer.

3. The puzzle of claim 2, wherein base portion includes on an outer surface thereof a portion of the second pictorial representation removed from said lower layer.

4. A puzzle comprising:

a base comprising a top layer, an intermediate layer and a lower layer, said base having a first pictorial representation provided on the top layer and a second pictorial representation provided on the lower layer, said representations each having sections removed therefrom to provide a plurality of blank sections at predetermined positions about said pictorial representations;

a track network provided within said base which interconnects said plurality of blank sections in both pictorial representations;

a plurality of independently rotatable, manipulative elements adapted to be moved curvilinearly about said track network from blank section to blank section without the necessity to remove said manipulative elements from said track network and, upon positioning of said elements within their appropriate blank section, further adapted to be rotated at said blank section relative to said pictorial representation to achieve a solution for said puzzle, wherein each of said elements include:

a face portion of a size and shape that substantially conforms to said blank sections in said base, said face portion including on an outer surface thereof a portion of said pictorial representation removed therefrom;

a neck portion which extends through said upper section of said track network and permits travel of said manipulative element about said track network from said blank section to said blank section; and a base portion adapted to retain said element within said track network while permitting said element to travel about said track network while further permitting said element to rotate relative to said base, said base portion further including on an outer surface thereof a portion of said pictorial representation removed from lower layer, wherein the width of said base portion is greater than the width of said track network, thereby retaining said element within said track network.

5. A method for solving a slide puzzle, said method comprising the steps of:

providing a slide puzzle of the type having:

a base comprising a top layer, an intermediate layer and a lower layer, said base having at least one pictorial representation provided on a surface thereof, said pictorial representation having sections removed therefrom to provide a plurality of blank sections at predetermined positions about said pictorial representation;

a track network provided within said base which interconnects said plurality of blank sections, said track network including an upper section provided in said top layer and a lower section provided in said intermediate layer, wherein the width of said lower section is greater than the width of said upper section;

a plurality of independently rotatable, manipulative elements adapted to be moved curvilinearly about said track network from blank section to blank section without the necessity to remove said manipulative elements from said track network and, upon positioning of said elements within their appropriate blank section, further adapted to be rotated at said blank section relative to said pictorial representation to achieve a solution for said puzzle, wherein each of said elements include:

a face portion of a size and shape that substantially conforms to said blank sections in said base, said face portion including on an outer surface thereof a portion of said pictorial representation removed therefrom;

a neck portion which extends through said upper section of said track network and permits travel of said manipulative element about said track network from blank section to blank section; and a base portion adapted to retain said element within said track network while permitting said element to travel about said track network while further permitting said element to rotate relative to said base, wherein the width of said base portion is greater than the width of said upper section, thereby retaining said element within said track network;

maneuvering said manipulative elements linearly about said track network from said blank section to said blank section;

positioning each manipulative element within said blank section that corresponds to the portion of said pictorial representation contained on said face portion of said element; and rotating each manipulative element to align the portion of said pictorial representation provided on said face portion of said element with said pictorial representation on said base.

* * * * *